US006446272B1

(12) United States Patent
Lee

(10) Patent No.: US 6,446,272 B1
(45) Date of Patent: Sep. 10, 2002

(54) BUCKLE ASSEMBLY FOR ADJUSTING STRAPS FOR HEADGEAR

(76) Inventor: Bom Kyu Lee, 107-1604 Hanshin Apt., 76 Yangpyung-don 5-GA, Youngdeungpo-ku, Seoul (KR), 150-105

( * ) Notice: Subject to any disclaimer, the term of this patent is extended or adjusted under 35 U.S.C. 154(b) by 0 days.

(21) Appl. No.: 09/830,256

(22) PCT Filed: Oct. 22, 1999

(86) PCT No.: PCT/KR99/00633

§ 371 (c)(1),
(2), (4) Date: Jul. 12, 2001

(87) PCT Pub. No.: WO00/24477

PCT Pub. Date: May 4, 2000

(30) Foreign Application Priority Data

Oct. 24, 1998 (KR) ..... 98/44674

(51) Int. Cl.[7] ..... A61F 9/02; A44B 11/10

(52) U.S. Cl. ..... 2/428; 2/452; 24/171; 24/196

(58) Field of Search ..... 2/452, 426, 428, 2/440, 442, 450; 24/171, 194, 196, 197, 265 BC, 323

(56) References Cited

U.S. PATENT DOCUMENTS 1,374,896 A * 4/1921 Arnold ..... 2/450
1,384,776 A * 7/1921 Posternock ..... 24/194
3,300,825 A * 1/1967 Andreasen ..... 24/16 PB
3,349,449 A * 10/1967 Hatfield ..... 24/197
4,527,292 A 7/1985 Kasama et al. ..... 2/452
4,607,398 A 8/1986 Faulconer ..... 2/452
5,181,280 A * 1/1993 Zachry, Jr. ..... 2/452
5,410,763 A 5/1995 Bolle ..... 2/436
5,432,984 A * 7/1995 Petzl ..... 24/170
5,471,714 A * 12/1995 Olson ..... 24/171
5,657,493 A 8/1997 Ferrero et al. ..... 2/428
5,727,259 A 3/1998 Kawamata ..... 2/452
5,774,947 A * 7/1998 Anscher ..... 24/171
5,956,778 A * 9/1999 Godoy ..... 2/428
6,247,187 B1 * 6/2001 Chiang ..... 2/428
6,317,897 B1 * 11/2001 Chiang ..... 2/428

* cited by examiner

*Primary Examiner*—Rodney M. Lindsey
(74) *Attorney, Agent, or Firm*—Ohlandt, Greeley, Ruggiero & Perle, L.L.P.

(57) ABSTRACT

The disclosure relates to a buckle assembly suitable for headgear such as swimming goggles of a type provided in combination with an elastic strap having a set of equally spaced teeth, projections, transverse ridges, arranged along the strap at least on the end portions of the strap, which enables easy adjustment of the length of the elastic strap. The disclosure also relates to a swimming goggle having such a buckle assembly.

8 Claims, 11 Drawing Sheets

BUCKLE ASSEMBLY FOR ADJUSTING STRAPS FOR HEADGEAR

BACKGROUND OF THE INVENTION

1. Field of the Invention

This invention relates to buckle assemblies for headgear adjustment straps, and in particular, to buckle assemblies for adjusting elastic straps for swimming goggles.

2. Description of the Prior Art

Currently available buckle assemblies for swimming goggles generally include a strap length-adjusting piece 17 which is formed on either, outer side portions of a lens frame 18 as shown in FIG. 1. Such strap length-adjusting piece 17 has at least two elongated openings through which ends of strap 15 pass. These through openings are disposed in a side-by-side relationship as shown in FIG. 2. Strap 15 is wrapped around a wall portion 17*a* between the two through openings. In order to enable strap 15 to be easily removed from the strap length-adjusting piece 17 to adjust length, the center portion of an outermost wall portion 17*b* is partially cut-out. Strap 15 is disposed in the strap length-adjusting piece 17 by passing a free end 15*a* of strap 15 through one of the openings which is adjacent to the lens part from the rear side of the piece, and then passing the same free end of the strap through the outermost opening.

A swimming goggle generally includes a lens assembly 13 having two lens frames 18 each having a lens part 11 fixed therein, with a nose bridge 14 connecting the inner sides of the lens frames. Head strap 15 connects the outer sides of the lens assembly 13. Each of the lens parts 11 generally has a silicon packing 12 provided on the wearer facing side thereof. Silicon packing 12 has a face engaging surface which is adapted to comfortably engage the wearer's face and compliantly follow the contour of the wearer's face due to its compressibility.

Accordingly, the wearer adjusts the length of the elastic strap by pulling one end 15*a* of the elastic strap 15 which is wrapped around strap-supporting portion 17*a* of the strap length adjusting piece 17, usually before wearing the swimming goggle. Once worn, silicon packing 12 seals to the skin of the face so that water does not leak into the interior of each lens part. If the elastic strap is too tightly adjusted, silicon packing 12 presses excessively around the eyes, which may result in pain in the skin around the eyes. If elastic strap 15 is too loosely adjusted, water may leak into lens part 11 past the silicon packing 12. For these reasons, adjustments to the length of the elastic strap 15 is required before a swimming goggle is put on to apply adequate pressure to the face.

In swimming goggles having the above-described buckle assembly, a wearer cannot adjust the length of the elastic strap 15 while wearing the swimming goggle on his head. The wearer must take off the swimming goggle from his head to adjust the length of the elastic strap. This adjusting operation is often repeated several times which may be extremely inconvenient.

SUMMARY OF THE INVENTION

One object of the present invention is to overcome such problems with prior art buckle assemblies, and to provide a buckle assembly which makes tightening and loosening operations simpler, quicker and more convenient with a simple arrangement such that the operations may be accomplished with only one hand and ensures the highest functional reliability of the buckle assembly.

Another object of the present invention is to provide a swimming goggle provided with such a buckle assembly which enables the wearer to perform the tightening and loosening operations while wearing the swimming goggle on his head.

The invention achieves the above objects by providing a buckle assembly for releasably fixing a strap and having a plurality of width-wise ridges, comprising a buckle body further comprising a strap-supporting portion around which the strap is wrapped; a slider, slidable between a first position and a second position with respect to the strap-supporting portion; the slider further comprising a strap-pressing piece which presses down the strap against the strap-supporting portion in its first position; and wherein, when the strap is pulled, one of the ridges engages with the strap-pressing piece to move the slider to the second position and, when the strap is released, another one of the ridges is engaged with the strap-pressing piece to move the slider to the first position.

Other objects, features and advantages of the invention will be apparent from the following detailed descriptions of the various embodiments taken in connection with the accompanying drawings.

BRIEF DESCRIPTION OF THE DRAWINGS

FIG. 5 illustrates the fixed state of the buckle assembly after the length of the elastic strap has been adjusted, and FIG. 6 illustrates the released state allowing the adjustment of the length of the strap.

FIG. 9 shows the first position of the slider, and FIG. 10 shows the second position of the slider.

DETAILED DESCRIPTION OF THE INVENTION

Various embodiments of the present invention will be described with reference to the accompanying drawings. The buckle assembly is described with particular reference to embodiments which are applied to swimming goggles. However, it should be understood that the buckle assembly of the present invention can also be used in combination with any strap which has to be repeatedly tightened and loosened for adjusting its length.

Figure 1:
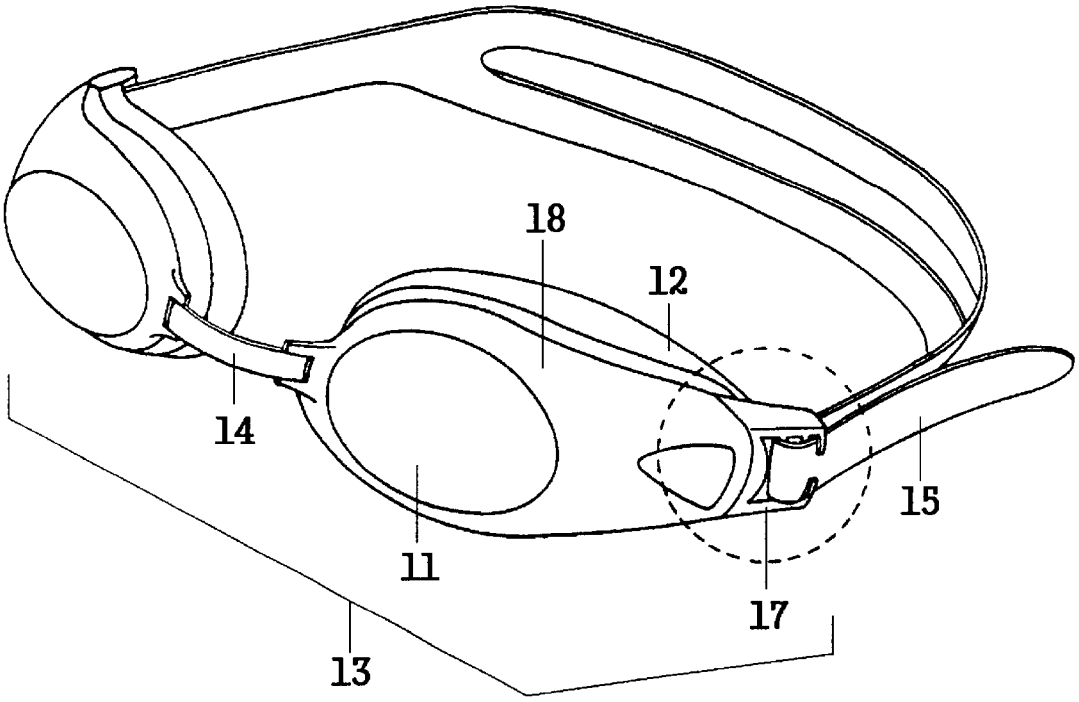
Fig. 1 PRIOR ART
FIG. 1 is a perspective view of a prior art swimming goggle having a conventional strap length-adjusting piece.
Figure 2:
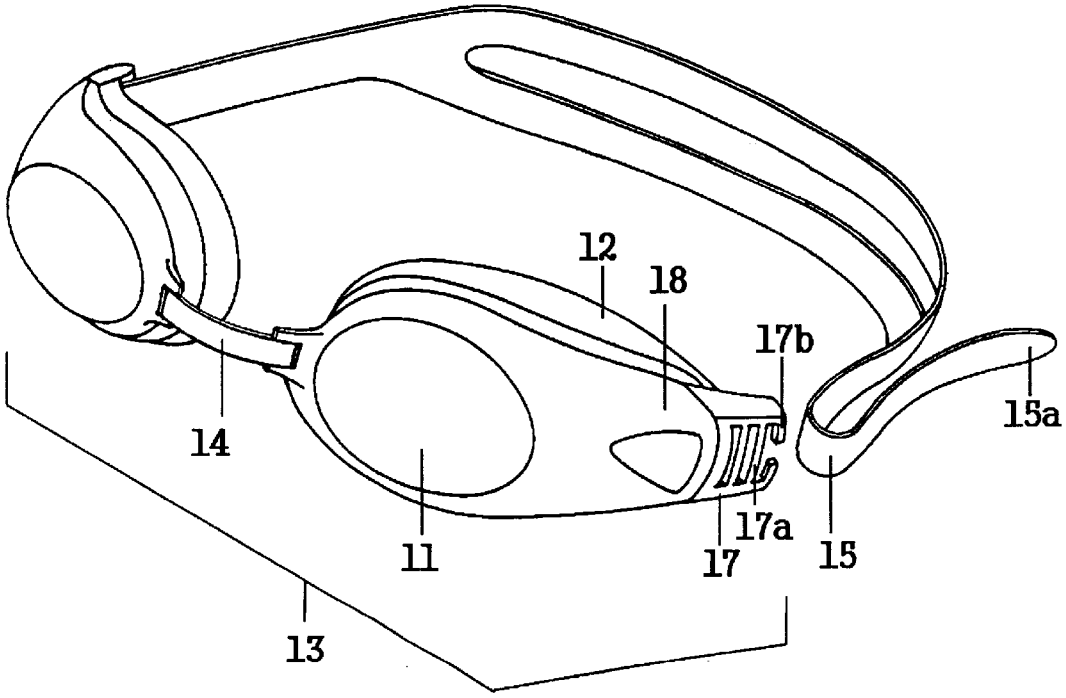
Fig. 2 PRIOR ART
FIG. 2 shows the prior art swimming goggle of FIG. 1 with its strap disengaged from the strap length adjusting piece.
Figure 3:
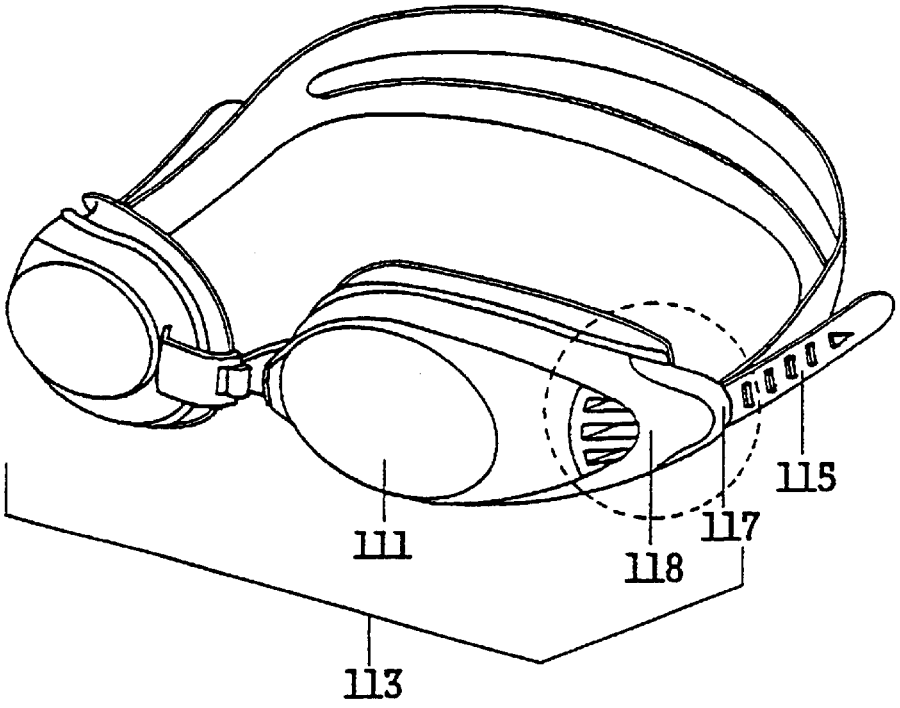
FIG. 3 is a perspective view of the swimming goggle provided with a buckle assembly according to the first embodiment of the present invention.

The term "longitudinal" referred to herein is used to indicate the circumferential direction of a fully assembled swimming goggle as shown in FIG. 3. The term "transverse" referred to herein is used to indicate the direction perpendicular to the "longitudinal" direction.

First Embodiment

Figure 4:
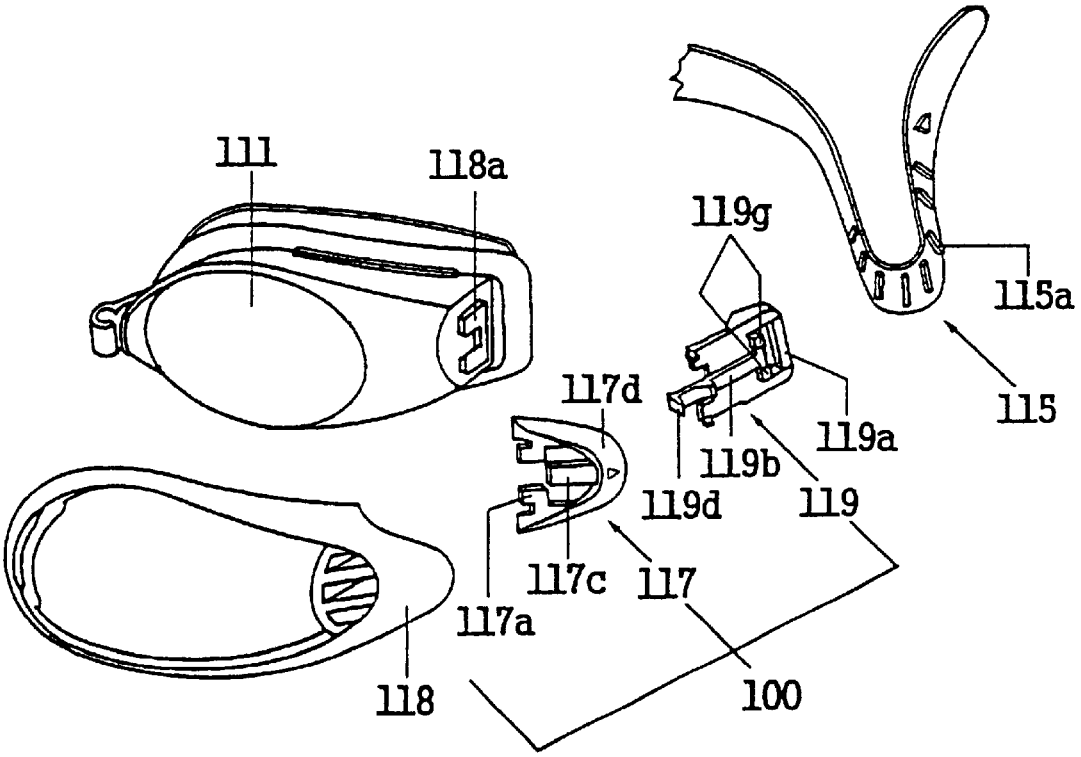
FIG. 4 is an exploded perspective view of the different components of the swimming goggle shown in FIG. 3.

FIGS. 3 and 4 illustrate perspective and exploded views of a swimming goggle having a buckle assembly 100 of the first embodiment of the present invention.

The swimming goggle comprises a lens assembly 113 comprised of a pair of lens parts 111 and a pair of lens frames 118 each combining a lens part 111 therein. and an elastic strap 115 for holding the swimming goggle on a person's head.

According to this embodiment, the buckle assembly 100 is detachably attached on each outer side portion of the lens assembly 113 to connect the lens assembly 113 and the elastic strap 115. In order to fasten the buckle assembly 100 on the outer side portion of the lens assembly 113 as shown in FIG. 4, fastening means such as spaced apart projections 118*a* are provided on each outer side portion of the lens parts 111. Between these projections 118*a* are press fitted spaced ribs 118*b* (FIG. 13) integrally formed on the bottom side of the lens frame 118, which will be further described hereinbelow. In this manner, the slider 117 can be maintained in a slidable relationship with respect to the buckle body 119 between the outer side portion of a lens part 111 and a lens frame 118.

The buckle assembly 100 of this embodiment comprises a buckle body 119 including a strap-supporting portion 119*a* around which a strap 115 is wrapped, and a slider 117 which is slidable between a first position and a second position with respect to the strap-supporting portion 119*a* and which also has a strap-pressing piece 117*b* (FIG. 12C) integrally formed on its bottom side for pressing down strap 115 against the strap-supporting portion 119*a* when the slider 117 is in its first position. The lens frame 118 is fastened on the outer side portion of the lens assembly 113 by means of the spaced ribs 118*b* so as to prevent the buckle body 119 and the slider 117 from being removed from the lens assembly 113.

The buckle body 119, the slider 117 and the lens frame 118 adapted for the buckle assembly 100 of this embodiment will next be described in greater detail.

Figure 11A:
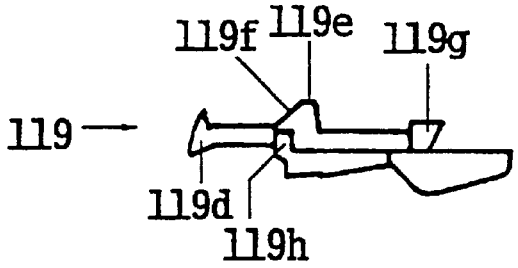
FIGS. 11A, 11B and 11C are side, plan and bottom views, respectively, of the buckle body of the buckle assembly.
Figure 11B:
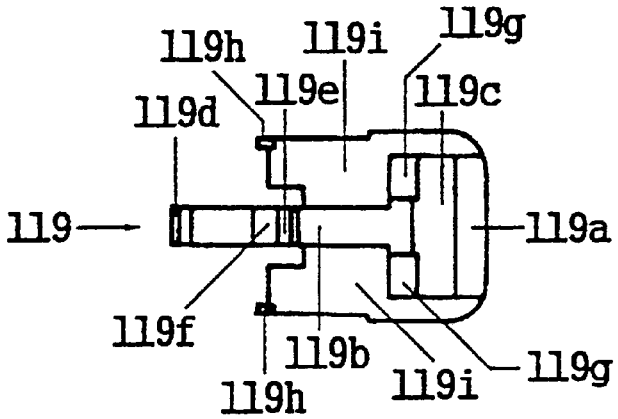
Figure 11C:
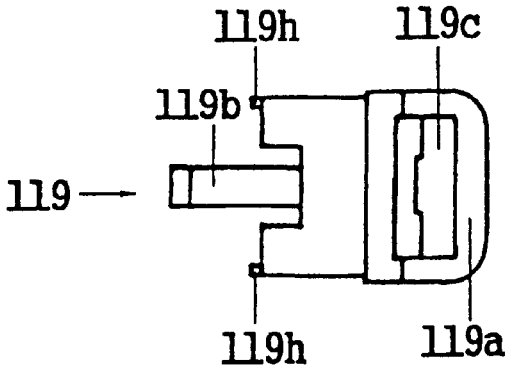

Referring to FIGS. 11A, 11B and 11C, side, plan and bottom views of the buckle body 119 according to this embodiment are shown. As shown in FIG. 11B, the buckle body 119 is comprised of a generally rectangular flat plate member having an elongated first guide rail 119*b* which extends longitudinally along a center line of the plate member and projects outwardly therefrom, and a pair of second guide sections 119*i* extending parallel to and on both sides of the first guide rail 119*b*. On one side end of the buckle body 119, a rectangular opening 119*c* is provided to define the strap-supporting portion 119*a*. The outwardly directed latch hook 119*d* is provided at the distal end of the first guide rail 119*b* for interengagement with the lens frame 118. Intermediate of the first guide rail 119*d*, a raised boss 119*e* is provided. The raised boss 119*e* has an angled or chamfered surface 119*f* on the side facing the latch hook 119*d*. A pair of first stoppers 119*h* are protruded from the outside corner at one end of each second guide section 119*i*. The pair of first stoppers 119*h* define the slider's first position. At the corner of the other end of each second guide section 119*i*, a pair of second stoppers 119*g* are formed opposite to the pair of first stoppers 119*h*. The pair of second stoppers 119*g* define the slider's second position. An upper surface of the body between the first stoppers 119*h* and the second stoppers 119*g* defines a sliding surface over which the slider described hereinafter slides.

Figure 12A:
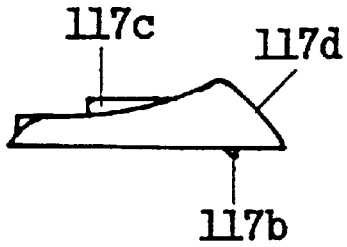
FIGS. 12A, 12B and 12C are side, plan and bottom views, respectively, of the slider of the buckle assembly.
Figure 12B:
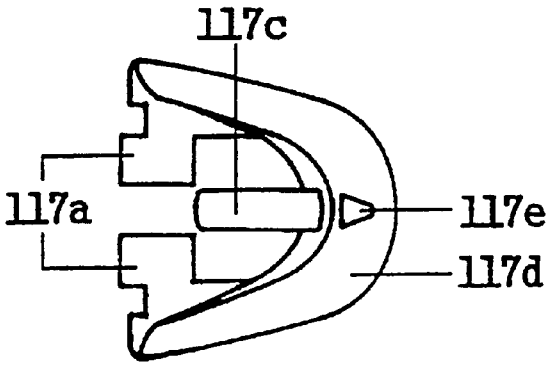
Figure 12C:
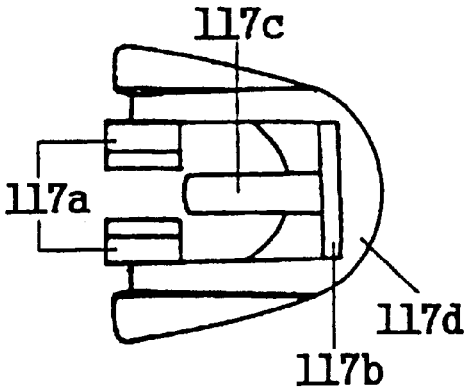

Referring to FIGS. 12A, 12B and 12C, side, plan and bottom views of the slider 117 which slides on the above-described buckle body 119, are shown. Referring to FIG. 12C illustrating the bottom side of the slider 117, the slider 117 comprises a pair of first sliding elements 117*a* sliding on the second guide sections 119*i* between the first position (FIG. 9) in which the sliding elements 117*a* abut against the pair of first stoppers 119*h*, and the second position (FIG. 10) in which the sliding elements 117*a* abut against the pair of second stoppers 119*g* with the first guide rail 119*b* guiding the sliding motion of the slider 117. The slider 117 also comprises a center second sliding element 117*c* sliding along the first guide rail 119*b* of the buckle body 119. An arched common portion 117*d* interconnects the pair of first sliding elements 117*a* and the second sliding element 117*c*. When the slider 117 is slidably located on the buckle body 119, the first sliding elements 117*a* of the slider 117, slide on the second guiding sections 119*i* between the pair of first and second stoppers. From the bottom side of a slider 117, an integrally formed strap-pressing piece 117*b* extends downwardly at a position facing the strap-supporting portion 119*a* when the slider 117 is positioned in the first position with respect to the buckle body 119.

Figure 5:
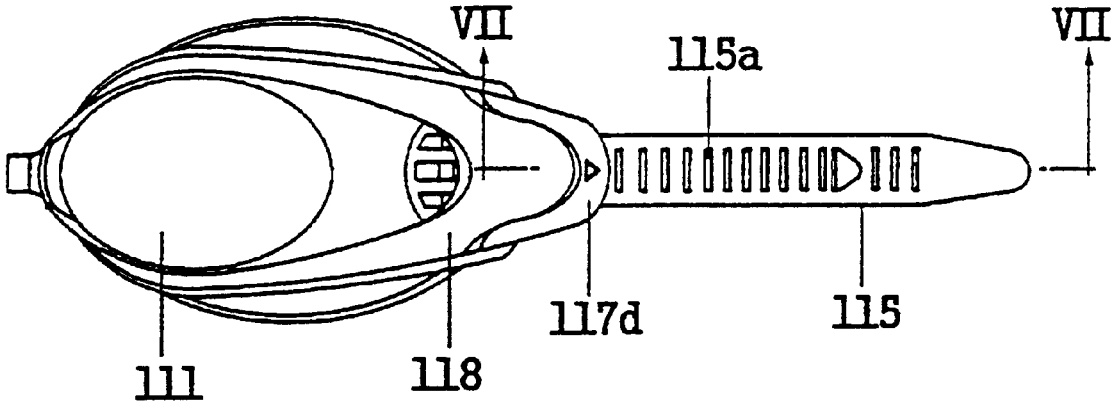
FIGS. 5 and 6 are elevated side views of a portion of the present swimming goggle for illustrating the operations of the buckle assembly according to a first embodiment of the present invention.
Figure 6:
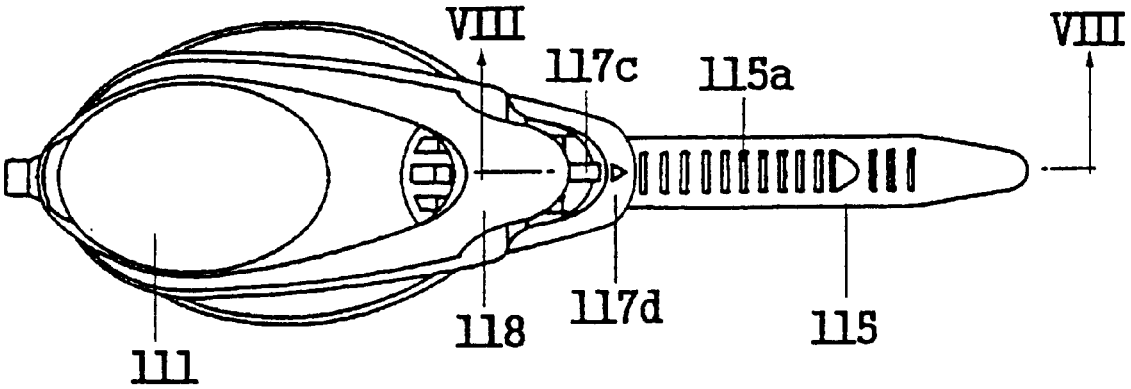

Referring to FIG. 12A, it is shown that the arched common portion 117*d* interconnects outer ends of the pair of first sliding elements 117*a* and a second sliding element 117*c*. As shown in FIG. 5, the arched portion 117*d* is shaped to mate with the lens frame 118 in a fully assembled buckle assembly. When the lens frame 118 is positioned onto the slider 117, the outer surface of a lens frame 118 forms a smooth curved surface together with that of the arched common portion 117*d*, thereby providing a simple and functional design, which is preferable for a swimming goggle. Additionally, a triangular projection 117*e* may be provided on the outer surface of the common portion 117*d* which may be engaged by a finger of a user. This triangular projection 117*e* may enhance friction between the outer surface of the common portion 117*d* and the finger of the user, and thus, may assist in sliding the slider 117.

Figure 9:
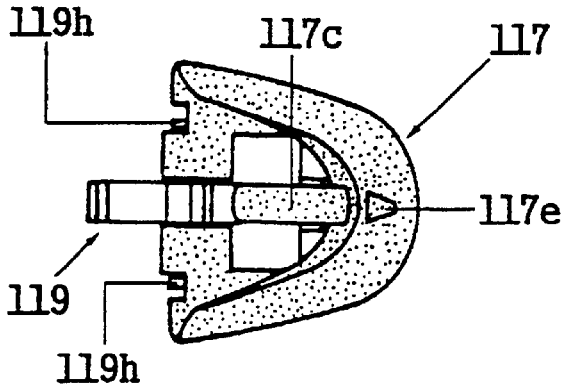
FIGS. 9 and 10 show the relative movements of the slider with respect to the buckle body of the buckle assembly of the first embodiment.
Figure 10:
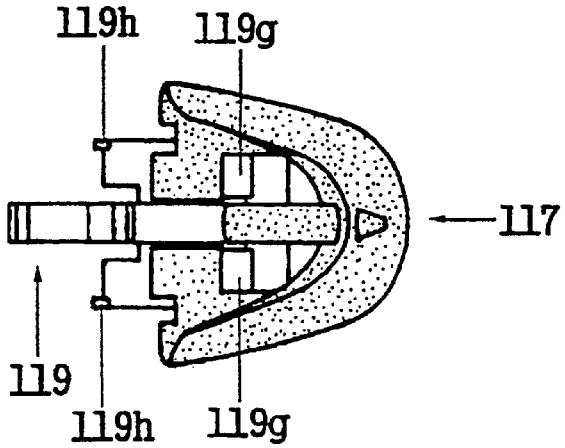

In the first position, the sliding elements 117*a* abut against the pair of first stoppers 119*h* (FIG. 9). In the second position, the sliding elements 117*a* abut against the pair of second stoppers 119*g* (FIG. 10).

Figure 7:
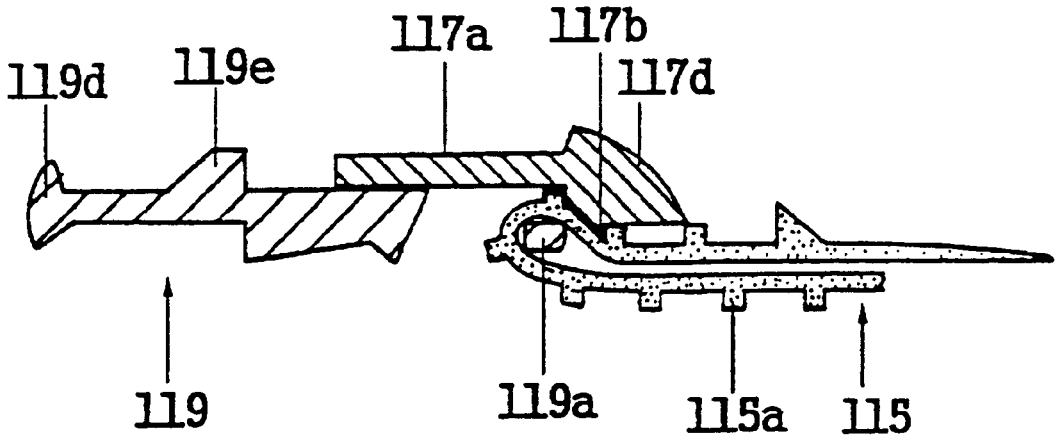
FIG. 7 is a cross-sectional view taken along line VII—VII in FIG. 5, depicting the slider in its first position.
Figure 8:
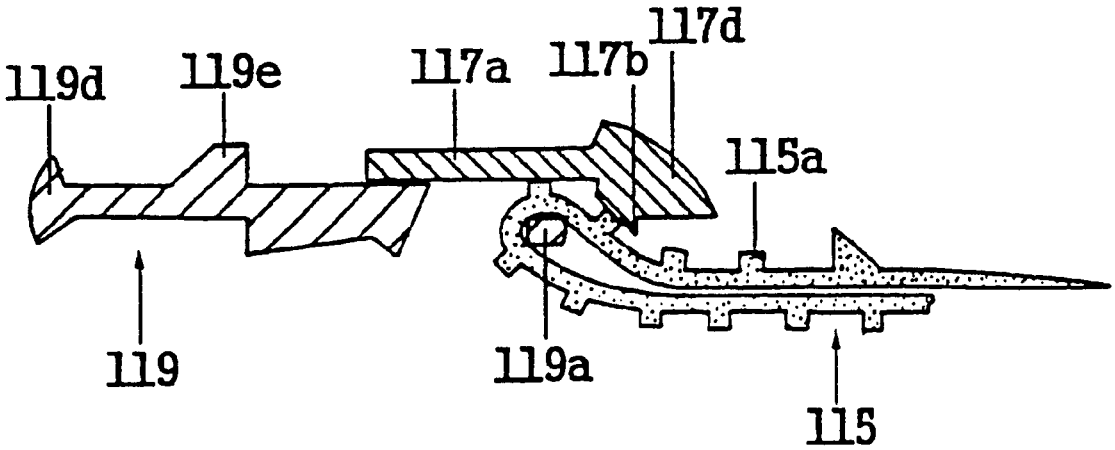
FIG. 8 is a cross-sectional view taken along line VIII—VIII in FIG. 6, depicting the slider in its second position.

In the first position shown in FIG. 9, the strap-pressing piece 117*b* integrally formed on the bottom side of the slider 117 is positioned opposite to the strap-supporting portion 119*a* with a distance to press more than a half width of the strap 115. In this position, the strap 115 wrapped around the strap-supporting portion 119*a* is pressed against the strap-supporting portion 119*a* by the strap-pressing piece 117*b* as shown in FIG. 7. In addition, when the length of the strap 115 is loosened, the slider 117 can be moved to slide to a second position as shown in FIG. 10. In this position, the clearance between the strap-pressing piece 117*b* and the strap-supporting portion 119*a* becomes larger, thus the strap 115 can move more easily therebetween.

Figure 13:
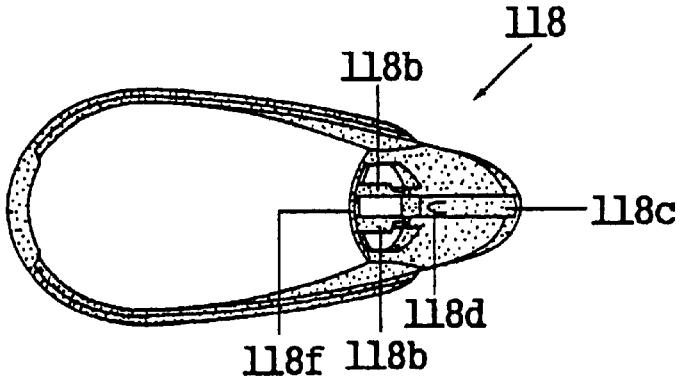
FIG. 13 is a bottom view of a lens frame of the buckle assembly according to the first embodiment of the present invention.

In the following, the details of the lens frame 118 will be described. The lens frame 118 is fastened in the above-described spaced apart projections 118*a* provided on the outer side portion of the lens part 111 with the buckle body 119 and the slider 117 interposed therebetween. On the bottom side of the outer side portion of the lens frame 118, a mounting piece for press-fitting between the projections 118*a* is provided as shown in FIG. 13. The mounting piece is shaped as spaced ribs 118*b* so as to be relatively flexible to the more rigid projections 118*a*. A groove 118*c* in which the second sliding element 117*c* engages when a slider 117 slides over a buckle body 119 in a fully assembled state, extends longitudinally on the bottom side of the outer side portion of the lens frame 118. In addition, a recess 18*d* is formed in the groove 118*c* at a position where the raised boss 119*e* provided on the center rail 119*b* is located. A mating portion 118f which engages the latch hook 119*d* in a mechanical interlocking engagement is formed between the spaced ribs 118*b*.

On both ends of the elastic strap 115, a plurality of transverse ridges 115*a* are equally spaced on the surface opposing the strap-pressing piece 117*b*. When at least one end of the elastic strap 115 is pulled in a tightening direction, one of the ridges on the stretching strap engages the strap-pressing piece on the bottom side of the slider and moves the slider to its second position. When the strap is released, the strap contracts and simultaneously one of the other ridges pushes the strap-pressing piece 117*b* to move the slider 117 to its first position. These ridges 115*a* have a height sufficient to be engaged by the strap-pressing piece. While the strap-pressing piece 117*b* moves by engagement with one of the ridges 115*a* on the contracting strap 115, the slider 117 having the strap-pressing piece 117*b* integrally formed on the bottom side thereof slides from its second position to its first position. In the first position of the slider, the length of the elastic strap 115 is fixed since the strap-pressing piece 117*b* is pressed against the strap-supporting portion 119*a*.

Same parts may be used to provide two opposite buckle assemblies, for example to the right and to the left of the swimming goggle. The parts employed for each of the buckle assembly are substantially identical to each other.

When the strap is used to tighten the lens assembly to the head of a wearer, for example in a swimming goggle, the strap contacts the head with its smooth face. Teeth, projections, ridges or the like are provided only on a predetermined portion at both ends of the strap.

The wearer may perform the tightening and loosening operations while wearing the swimming goggle of this embodiment on his head, in a simpler, quicker and more convenient way.

Second Embodiment

Figure 14:
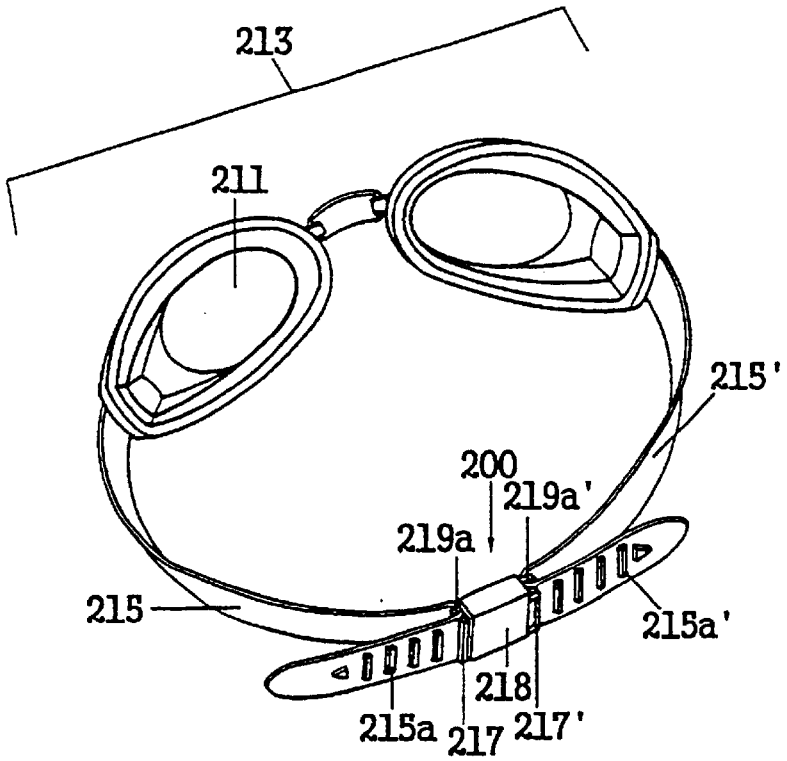
FIG. 14 is a perspective view of a swimming goggle having a buckle assembly according to a second embodiment of the present invention.
Figure 15:
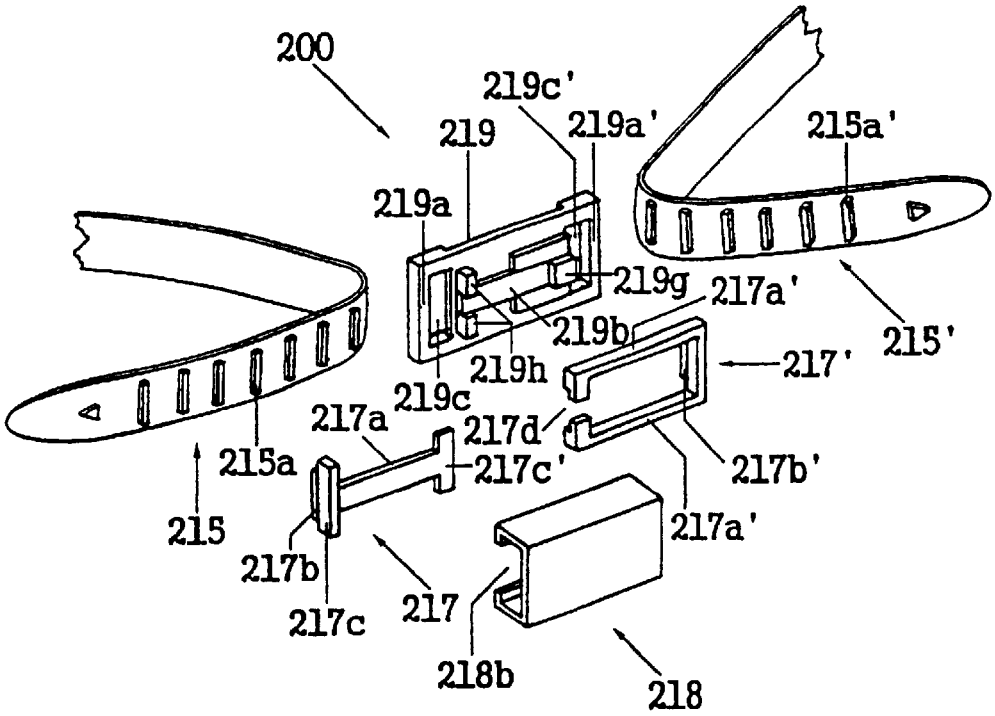
FIG. 15 is an exploded perspective view of the different components of the swimming goggle shown in FIG. 14.

Referring to FIGS. 14 and 15, a swimming goggle having a buckle assembly 200 according to a second embodiment of the present invention is shown in perspective and exploded views, respectively.

As shown in the drawings, two straps 215 and 215' each of which having a plurality of width-wise ridges 215*a* and 215*a*' are coupled to each end of respective lens part 211. Each of the elastic straps 215 and 215' is wrapped around respective first and second strap-supporting portions 219*a* and 219*a*' both formed in a single buckle assembly 200. The buckle assembly 200 of this embodiment is separately formed from the lens assembly 213.

The buckle assembly 200 of this embodiment comprises a buckle body 219 having the first and a second strap-supporting portions 219*a* and 219*a*' wrapped around by the first and second straps 215 and 215', respectively. A first and a second sliders 217 and 217' are slidable between the first position and second position with respect to a first and a second strap-supporting portions 219*a* and 219*a*', respectively. The first and second sliders 217 and 217' have the first and second strap-pressing pieces 217*b* and 217*b*' integrally formed on each of their bottom side in order to press first and second straps 215 and 215' against the first and second strap-supporting portions 219*a* and 219*a*' when first and second slider 217 and 217' are in their first positions, such that straps 215 and 215' are prevented from being released in their loosening direction. The buckle assembly 200 further comprises a slider cover 218 which prevents the first and second sliders being disengaged from the buckle body 219.

The buckle body 219 is generally a rectangular flat plate member. Two openings 219*c* and 219*c*' are formed at both ends of the buckle body 219 to provide the first and second strap-supporting portions 219*a* and 219*a*' around which the first and second straps 215 and 215' are wrapped, respectively. A guide section 219*b* extends longitudinally along the center of the buckle body 219 between the two openings 219*c* and 219*c*'. A pair of first stoppers 219*h* are formed on both sides at one end of the guide section 219*b*. These first stoppers 219*h* have a height higher than that of the guide section 219*b*. A second stopper 219*g* is formed on the other end of the guide section 219*b*. The range of the sliding motion of the first slider 217 is defined between the first stopper pair 219*h* and the second stopper 219*g*.

As shown in FIG. 15, the first slider 217 comprises a longitudinally extending body 217*a* having a surface facing the guide section 219*b* of the buckle body 219, a first transverse extension 217*c* provided on one end of the body 217*a*, and a second transverse extension 217*c*' provided on the other end of the body 217*a*. The first transverse extension 217*c* abuts against the second stopper 219*g* in its first position and against the first stopper pair 219*h* in its second position. The second transverse extension 217*c*' abuts against the first stopper pair 219*h* in its first position, and has a height higher than the other portions of the first slider 217. In addition, the first strap-pressing piece 217*b* is integrally formed on the bottom side of the first transverse extension 217*c*, and the second strap-pressing piece 217*b*' is integrally formed on the bottom side of the second transverse extension 217*c*'.

When the first slider 217 slides along the guide section 219*b*, the body 217*a* of the first slider 217 passes between the first stopper pair 219*h* and slides until it abuts against the second stopper 219*g*.

The second slider 217' is a generally rectangular frame composed of four frame elements, two longitudinal frame elements and two transverse frame elements. Opposing surfaces of a pair of longitudinal elements 217*a*' support both ends of the first transverse extension 217*c* of the first slider 217. One of the transverse frame element has a cut-out portion 217*d* dimensioned in such a way as to allow the passage of the body 217*a* of the first slider 217 while preventing the passage of the first transverse extension 217*c* therethrough. After the first slider 217 is positioned on the buckle body 219, the second slider 217' is placed on the first slider 217 such that the first transverse extension 217*c* cannot pass through the cut-out portion 217*d* of the second slider 217' while sliding to their second positions.

In addition, the slider cover 218 holds the first and second sliders 217 and 217' in their assembled state with respect to the above-described buckle body 219. The slider cover 218 in this embodiment is a tube like element having a rectangular cross-section. In one of its four sides, a longitudinal cut-out 218*b* extending the entire length is formed. This longitudinal cut-out 218*b* may be elastically opened apart, for the receipt of the buckle body 219 and the first and second sliders 217 and 217'.

The swimming goggle of this embodiment also enables the wearer to tighten and loosen adjustments while wearing the swimming goggle on his head.

Third Embodiment

Figure 16:
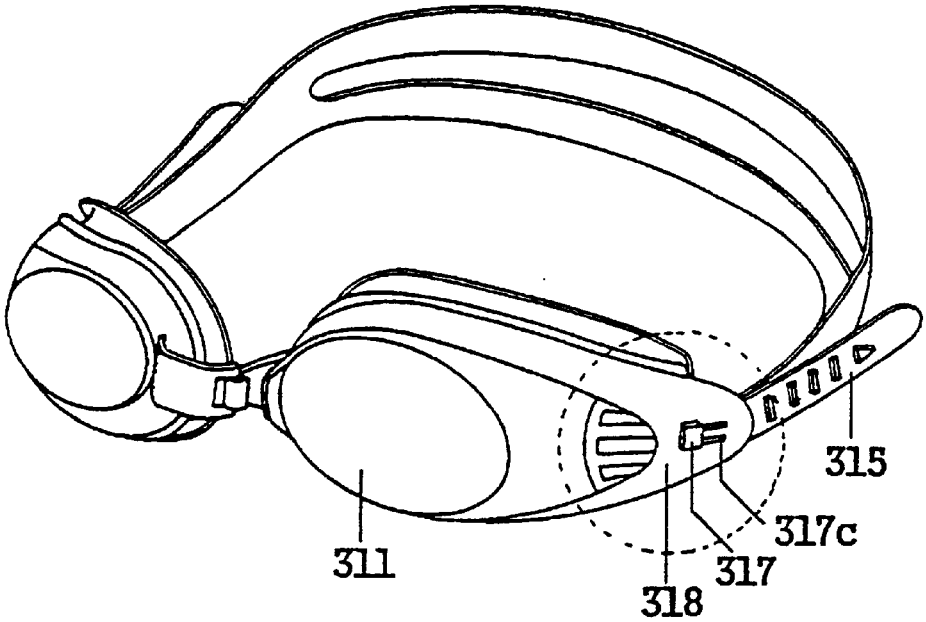
FIG. 16 is a perspective view of a swimming goggle having a buckle assembly according to a third embodiment of the present invention.
Figure 17:
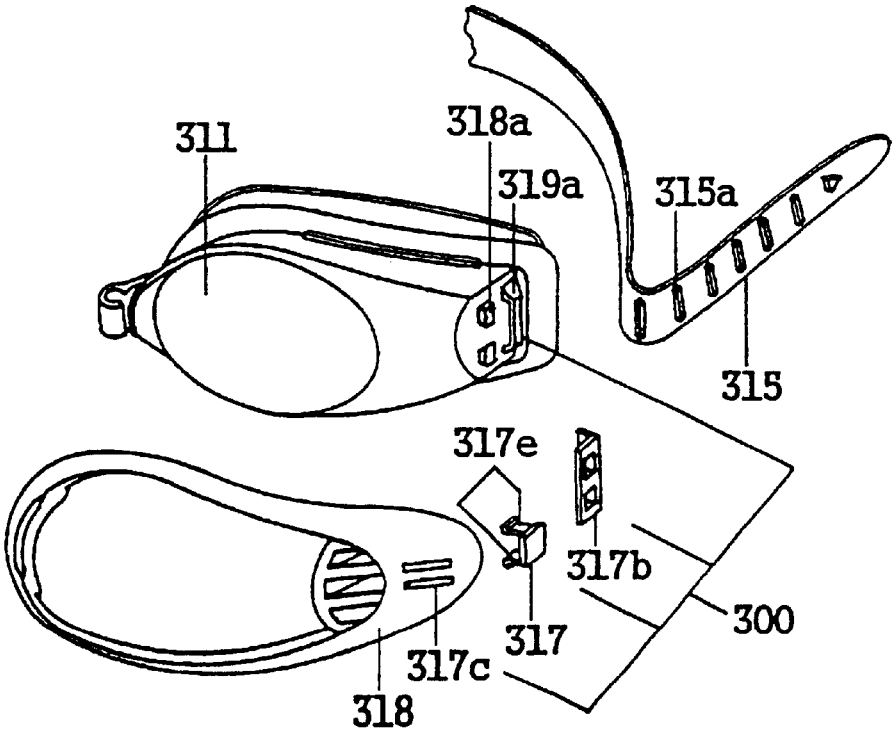
FIG. 17 is an exploded perspective view of the different components of the swimming goggle shown in FIG. 16.

Referring to FIGS. 16 and 17, a swimming goggle having a buckle assembly 300 according to the third embodiment of the present invention is shown in a perspective view and an exploded perspective view, respectively.

In this embodiment, a strap-supporting portion 319*a* is formed on each end of a lens part 311, together with two spaced projections 318*a* for fastening a lens frame thereto, as shown in FIG. 17.

A pair of parallel guideways 317*c* are formed on an outer side portion of the lens frame 318 for guiding the sliding motion of the slider 317 between its first and second positions. A slider 317 comprises a pair of leg portions 317*e* slidable along the guideways 317*c* with each of leg portions inserted therein. A strap-pressing piece 317*b* is separately formed from the slider 317, and is coupled to the leg portions 317*e* of the slider 317 inserted into the guideways 317*c*. Strap-pressing piece 317*b* is adapted to press the strap 315 against the strap-supporting portion 319*a* when the slider 317 is in its first position.

When the elastic strap 315 is pulled, the strap stretches and simultaneously one of said ridges 315*a* engages with said strap-pressing piece 317*b* to move said slider 317 to said second position, and when the elastic strap 315 is released, the strap contracts and simultaneously another one of the ridges 315*a* engages with the strap-pressing piece 317*b* to move the slider 317 to the first position. Thus, strap 315 is automatically fixed in the adjusted length when the strap 15 is released.

Fourth Embodiment

Figure 18:
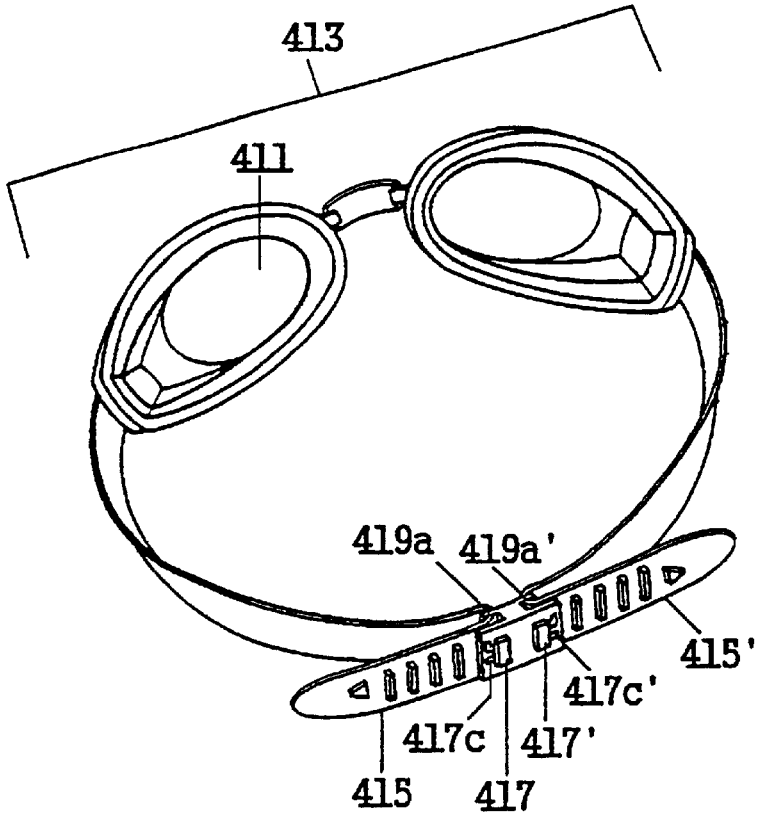
FIG. 18 is a perspective view of a swimming goggle having a buckle assembly according to a fourth embodiment of the present invention.
Figure 19:
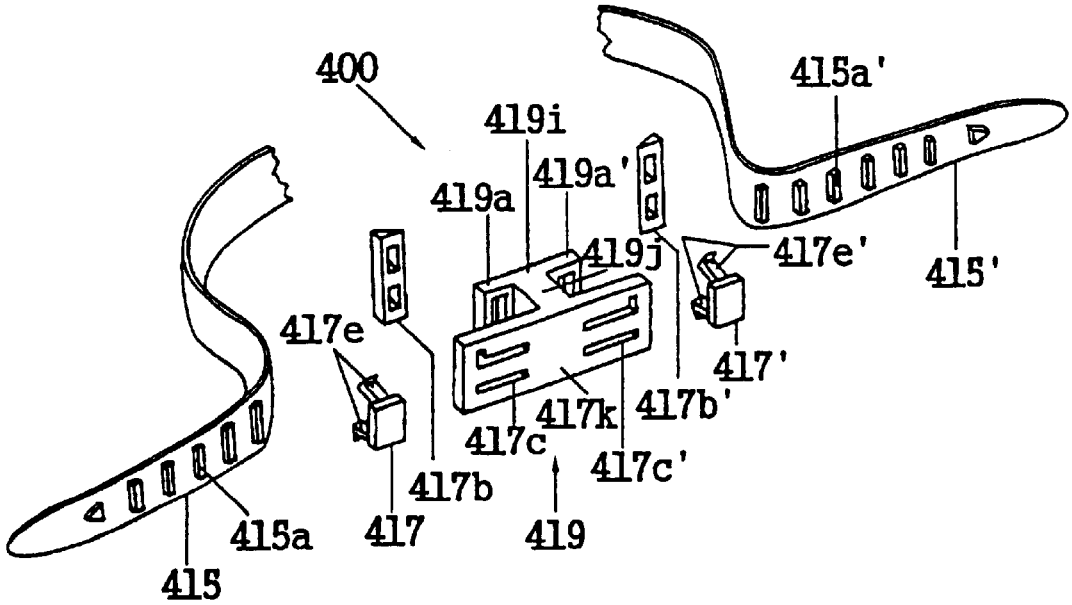
FIG. 19 is an exploded perspective view of the different components of the swimming goggle shown in FIG. 18.

Referring to FIGS. 18 and 19, a swimming goggle having a buckle assembly 400 according to a fourth embodiment of the present invention is shown in a perspective view and an exploded perspective view, respectively.

As depicted in the drawings, two straps 415 and 415' each of which has a plurality of width-wise ridges 415*a* and 415*a'* are coupled to each end of respective lens part 411. Each of the elastic straps 415 and 415' is wrapped around respective first and second strap-supporting portions 419*a* and 419*a'* both formed in a single buckle assembly 400. The buckle assembly 400 of this embodiment is separately formed from the lens assembly 413.

A swimming goggle of this embodiment comprises a lens assembly 413 comprised of a pair of lens parts 411 and a pair of lens frames 418 each of which is coupled to respective lens part 411. two elastic straps 415 and 415' each of which is coupled to an end of respective lens part 411 and has a plurality of width-wise ridges 415*a* and 415*a'*, and a buckle assembly 400 to which two straps 415 and 415' are connected.

A buckle body 419 of the buckle assembly 400 comprises a flat plate, a slider guiding plate 419*k* extending in a spaced, parallel relationship with respect to the flat plate, and a post 419*j* maintaining the flat plate and the slider guiding plate 419*k* in such a spaced relationship. The slider guiding plate 419*k* is provided with a pair of longitudinal first guideways 417*c* and a pair of longitudinal second guideways 417*c'* guiding the sliding motions of the first and second sliders 417 and 417' between their first position and second positions, respectively.

A first slider 417 comprises a pair of first leg portions 417*e* slidable along the first guideways 417*c* with each of the first leg portions inserted therein. A second slider 417' comprises a pair of second leg portions 417*e'* along the slidable second guideways 417*c'* with each of the second leg portions inserted therein.

First and second strap-pressing pieces 417*b* and 417*b'* are separately formed from the first and second sliders 417 and 417' and are coupled to the first and second leg portions 417*e* and 417*e'* of the first and second sliders 417, 417' inserted into respective first and second guideways 417*c* and 417*c'*.

Each of the first and second slider 417 and 417' slides along respective first and second guideways 417*c* and 417*c'* between a first position and a second position, respectively. When the first and second sliders 417 and 417' are in their first positions, their first and second strap-pressing pieces 417*b* and 417*b'* press the straps 415 and 415' against the first and second strap-supporting portions 419*a* and 419*a'* and fix the length of the straps, respectively.

Fifth Embodiment

Figure 20:
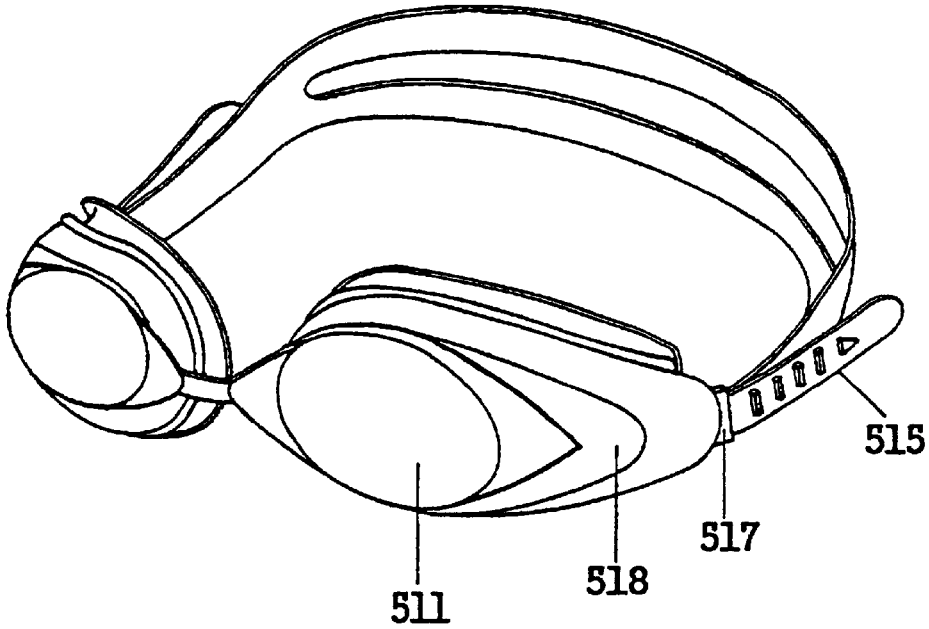
FIG. 20 is a perspective view of a swimming goggle having a buckle assembly according toga fifth embodiment of the present invention.
Figure 21:
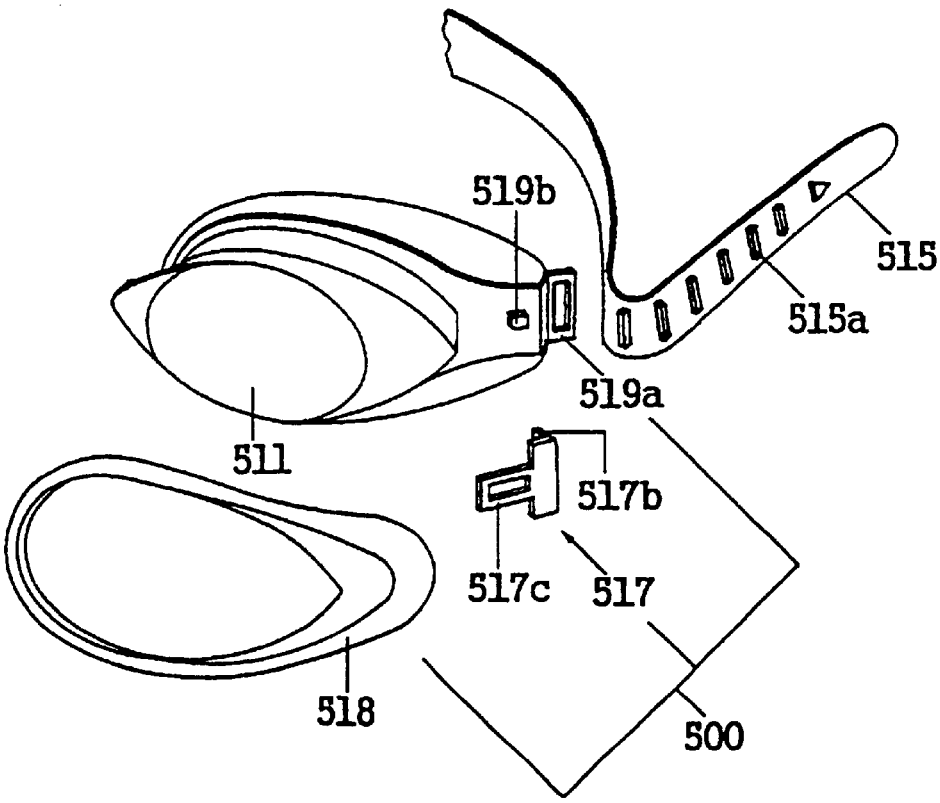
FIG. 21 is an exploded perspective view of the different components of the swimming goggle shown in FIG. 20.

Referring to FIGS. 20 and 21; a swimming goggle having a buckle assembly 500 according to a fifth embodiment of the present invention is shown in a perspective view and an exploded perspective view, respectively.

According to this embodiment, a strap-supporting portion 519*a* is formed on an outer side end of a lens part 511. On an outer side portion of the lens part 511, a post 519*b* for sliding along an elongated guiding slot 517*c* of a slider 517 is provided. From an end of the guiding slot 517*c*, an integrally formed band pressing piece 517*b* extends downwardly and is adapted to press the strap 515 wrapped around the band supporting portion 519*a* against the strap-supporting portion 519*a*. A lens frame 518 is adapted to be snap fitted on each lens part 511. A slider 517 is placed between the lens frame 518 and an outside surface of the lens part 511.

The above description clearly shows the advantages of the present invention. The advantageous effects are the simplicity and easiness of the tightening and loosening operations. Moreover, the considerable simplicity of the parts comprising the buckle assembly contributes to operational reliability and extended life, as well as simplicity for the buckle assembly itself. The parts comprising the buckle assembly may all be manufactured as molded plastic parts made of a durable material, generally little affected by influences of external factors such as chlorine, salt water and the like. However, the materials used to fabricate the buckle assembly may also be of other types, depending on the field of use. Such alternate materials are considered within the scope and spirit of the present disclosure.

From the foregoing, it is also appreciated that the buckle assemblies are not confined to be used with any particular types of straps. Rather, specific materials for particular purposes can be used for the straps. By way of example, an elastic strap was shown.

In addition, the buckle assemblies of the present invention do not have excessive space or volume requirements and can be advantageously used in an article such as a swimming goggle having limited space for buckle assembly attachment. A buckle assembly according to the present invention can be fabricated of a size at least equal to or slightly smaller than usual buckle assemblies.

Although the buckle assembly of the present invention is described for use in combination with a swimming goggle, its use is not limited thereto, and may be provided on any article in combination with any strap which has to be repeatedly tightened and loosened.

The invention is not intended to be limited to the embodiments described and illustrated herein and may be greatly varied especially with regard to construction without departing from the guiding principles disclosed above and claimed below.

What is claimed is:

1. A buckle assembly for use with aheadgear comprising:

a buckle body having a strap-supporting portion around which an elastic strap is wrapped, said strap having a width and a plurality of ridges parallel to said width;

a slider including a strap-pressing piece for pressing said strap against said strap-supporting portion, said slider being slidable between a first position where movement of said plurality of ridges through a space between said strap pressing piece and said strap-supporting portion is blocked by said strap-pressing piece, and a second position where the movement of said plurality of ridges through said space is allowed; and wherein one of said plurality of ridges engages with said strap-pressing piece to move said slider to said second position when said strap is pulled and a second of said plurality of ridges is engaged with said strap-pressing piece to move said slider to said first position when said strap is released.

2. A swimming goggle comprising:

a lens assembly having a pair of lens parts and a pair of lens frames, said pair of lens frames being connected to a respective one of said pair of lens parts;

a buckle assembly as defined in claim 1 connecting said lens assembly and said elastic strap;

means for fastening said pairs of lens frames formed on an outer side portion of each of said pair of lens parts;

said buckle body further comprising a first guide section longitudinally extending along a center line on an upper surface thereof, a pair of second guide sections extending parallel to and on both sides of said first guide section, a first stopper formed on one end of said pairs of second guide sections to define said first position of said slider, and a second stopper formed on the other end of said pair of second guide sections and facing said first stopper formed on the other end of said pair of second guide sections and facing said first stopper to define said second position of said slider; and said slider having a pair of first sliding elements slidable over said pair of second guide sections and a second sliding element, said first sliding elements abutting against said first stopper in said first position and abutting against said second stopper in said second position, said second sliding element slidable over said first guide section.

3. A swimming goggle comprising:

a lens assembly having a pair of lens parts and a pair of lens frames, each of said pair of lens frames being connected to a respective one of said pair of lens parts;

a buckle assembly as defined in claim 1 connecting said lens assembly and said elastic strap;

means for fastening said pair of lens frame and said buckle body, formed on an outer side portion of each said pair of lens parts;

said lens frame having a pair of longitudinal guideways formed on an outer side portion thereof for guiding the sliding motion of said slider between said first position and said second position; and said slider having a pair of leg portions slidable along said guideways with each leg portion inserted therein.

4. The swimming goggle as claimed in claim 3, wherein said strap-pressing piece is separately formed from said slider and is connected to said leg portions of said slider and inserted into said guideways.

5. A buckle assembly for use with a headgear comprising:

a buckle body having a flat plate with a first and a second strap supporting portion around which first and second elastic straps are respectively wrapped, on a respective first and second side thereof, each of said first and second straps having a width and a plurality of ridges parallel to said width;

a first slider having a first strap-pressing piece for pressing said first elastic strap against said first strap-supporting portion, said first slider being slidable between a first position where movement of said plurality of ridges of said first elastic strap through a first space between said first strap pressing piece and said first strap-supporting portion is blocked by said first strap-pressing piece, and a second position where movement of said plurality of ridges of said first elastic strap through said first space is allowed;

a second slider having a second strap-pressing piece for pressing said second elastic strap against said second strap-supporting position, said second slider being slidable between said first position where movement of said plurality of ridges of said second elastic strap through a second space between said second strap-pressing piece and said second strap-supporting portion is blocked by said second strap-pressing piece, and a second position where movement of said plurality of ridges of said second elastic strap through said second space is allowed; and wherein said first strap is stretched and simultaneously one of said plurality of ridges of first elastic strap engages said first strap-pressing piece to move said first slider to its second position when said first elastic strap is pulled, and said first strap contracts and simultaneously a second one of said plurality of ridges of said first elastic strap engages said first strap-pressing piece to move said first slider to its first position, when said first elastic strap is released; and wherein said second strap is stretched and simultaneously said one of said plurality of ridges of said second elastic strap engages said second strap-pressing piece to move said second slider to its second position when said second elastic strap is pulled, and said second strap contracts and said second of said plurality of said ridges of said second elastic strap engages said second strap-pressing piece to move said second slider to its first position when said second elastic strap is released.

6. A swimming goggle comprising:

a lens assembly having a pair of lens parts and a pair of lens frames, said pair of lens parts being connected to a respective one of said pair of lens frames;

each of said two straps being connected to an end of said respective one of said pair of lens parts;

a buckle assembly as defined in claim 5 to which said two straps are connected;

said buckle body having a guide section longitudinally extending along a center line on an upper surface of said flat plate, a pair of first stoppers protruded from a respective first and second side at one end of said guide section and having a height higher than that of said guide section, and a second stopper protruded from the other end of said guide section;

said first slider having a longitudinally extending body with a surface facing said guide section of said buckle body, a first transverse extension being provided on one end of said body to abut against said second stopper in its first position and against said first stopper in its second position, and a second transverse extension being provided on the other end of said body to abut against said first stopper in its first position;

said second slider being in the form of a generally rectangular frame composed of four frame elements, said four frame elements being a pair of longitudinal frame elements and a pair of transverse frame elements, said pair of longitudinal frame elements having opposing surfaces for supporting both ends of said first extension of said first slider, one of said pair of transverse frame elements having a cut-out portion dimensioned to allow the passage of the body of said first slider while preventing the passage of said first extension therethrough; and a slider cover slidably retaining said first and second sliders against said buckle body.

7. A swimming goggle comprising:

a lens assembly having a pair of lens parts and a pair of lens frames, said pair of lens frames being connected to a respective one of said pair of lens parts;

two elastic straps, each of said two straps being connected to an end of said respective one of said pair of lens parts and having a plurality of width-wise ridges;

a buckle assembly as defined in claim 5 to which said two straps are connected;

said buckle body having a slider guiding plate extending in a spaced, parallel relationship with respect to a flat plate of the buckle body and a post maintaining said flat plate and said slider guiding plate in a spaced relationship, said slider guiding plate being provided with a pair of longitudinal first guideways and a pair of longitudinal second guideways guiding the sliding motions of said first and second sliders between their first position and second positions, respectively;

said first slider having a pair of first leg portions slidable along said first guideways with each of said first leg portions inserted therein; and said second slider having a pair of second leg portions slidable along said second guideways with each of said second leg portions inserted therein.

8. The swimming goggle as claimed in claim 7, wherein said first strap-pressing piece is separately formed from said first slider, and is connected to said first leg portions of said first slider inserted into said first guideways; and said second strap-pressing piece is separately formed from said second slider, and is connected to said second leg portions of said second slider inserted into said second guideways.

* * * * *